United States Patent [19]

Waters et al.

[11] Patent Number: 4,952,175

[45] **Date of Patent: * Aug. 28, 1990**

[54] KEY RETENTION SYSTEM

[75] Inventors: Mark H. Waters, Harrisburg; Robert N. Whiteman, Jr., Middletown, both of Pa.

[73] Assignee: AMP Incorporated, Harrisburg, Pa.

[ * ] Notice: The portion of the term of this patent subsequent to May 23, 2006 has been disclaimed.

[21] Appl. No.: 317,306

[22] Filed: Feb. 28, 1989

Related U.S. Application Data

[63] Continuation of Ser. No. 90,294, Aug. 31, 1987, Pat. No. 4,832,624.

[51] Int. Cl.[5] ..... H01R 13/64

[52] U.S. Cl. ..... 439/681; 439/906

[58] Field of Search ..... 439/677-681, 439/674, 171, 173, 174, 177, 906

[56] References Cited

U.S. PATENT DOCUMENTS

| | | |
|---|---|---|
| 3,177,461 | 4/1965 | Hagan et al. . |
| 3,582,867 | 6/1971 | Bainbridge et al. . |
| 4,277,126 | 7/1981 | Lincoln . |
| 4,376,565 | 3/1983 | Bird et al. . |
| 4,580,868 | 4/1986 | Verstijnen . |

FOREIGN PATENT DOCUMENTS

| | | |
|---|---|---|
| 961714 | 12/1961 | United Kingdom . |
| 1089073 | 4/1965 | United Kingdom . |

OTHER PUBLICATIONS

AMP Incorporated Instruction Sheet IS 7404 Released 03/26/84.

"Insertion Error-Proof Board-To-Cable Connector".

EPO Standard Search Report.

EPO STD Search Report Annex.

*Primary Examiner*—David L. Pirlot

*Attorney, Agent, or Firm*—David L. Smith

[57] ABSTRACT

A key retention system for electrical connectors which includes a connector (12) including a lower backshell (42) having at least one generally T-shaped slot (51) extending therein from a side face (52) thereof for receiving a generally T-shaped key (61). Slot (51) and key (61) are configured to permit key (61) to be easily inserted into slot (51) in the correct orientation and to prevent key (61) from rotating or from moving laterally or longitudinally within slot (51) to any appreciable extent. Locking means comprising a projection (81) extending inwardly from the cover (43) for the lower backshell (42) is positioned to extend into the slot when cover (43) is mounted to lower backshell (42) to lock key (61) in position within slot (51).

16 Claims, 3 Drawing Sheets

KEY RETENTION SYSTEM

This is a continuation of application Ser. No. 090,294, filed Aug. 31, 1987.

BACKGROUND OF THE INVENTION

The present invention relates generally to electrical connectors, and, more particularly, to a key retention system for electrical connectors.

Electrical connectors are frequently provided with keying means to permit particular pairs of connectors to properly mate and to prevent the mating of connectors which are not intended to be mated. Keying means are especially useful when a plurality of identical connectors are positioned in close proximity to one another, for example, on a printed circuit board. The incorrect matching of complementary connectors to the connectors on the board can cause serious damage to the circuits improperly connected thereby; and the keying means, by ensuring that each complementary connector will mate with only the correct one of the plurality of connectors on the board, minimizes the risk of improper connection. Keying means are particularly important when the connections are made by untrained personnel as the risk of improper connection is especially great in such circumstances.

Keying systems are known in which a key member is secured in one of a pair of complementary connectors and is adapted to cooperate with an opposing key member secured in the other of the pair of connectors. Each key member is secured in its connector in a selected orientation with respect to its opposing key member so that when the connectors are intended to be mated, extended keying sections on the key members pass by each other during mating to allow the connectors to properly mate. If one of the key members is secured in an incorrect orientation with respect to its opposing key member, however, the extended keying sections on the key members will abut one another during mating to prevent proper mating of the connectors.

One known type of key member is provided with a portion having a polygonal cross-section and is adapted to be secured within a passageway in a connector in a selected orientation. The number of sides of the polygonal shape determines the number of possible orientations of the key member.

To ensure that the keying system operates reliably, it is important that the key members be accurately positioned and retained within their respective connectors with the keying sections thereof in the selected orientation. Any significant movement of a key member within its connector can prevent the proper mating of connectors which are intended to be mated, or permit the mating of connectors which are not intended to be mated. Many known keying systems, however, are not satisfactory in preventing movement of the key members.

Also, orienting of a key member and positioning and securing the key member in a connector is typically performed by hand, and, in many known keying systems is a difficult, time-consuming procedure. Orienting and securing of the key member is particularly troublesome in small connectors inasmuch as the key member also tends to be quite small and rather difficult to handle.

SUMMARY OF THE INVENTION

The present invention relates to a key retention system for electrical connectors that permits a key member to be quickly positioned and secured in a connector in a desired orientation, and which reliably retains the key member in the selected orientation. The key retention system of the invention comprises: a connector including structure for defining a generally T-shaped slot, the slot including an enlarged first slot portion and a second slot portion of reduced size extending from the enlarged slot portion to an end face of the structure; and a generally T-shaped key, the key including a body section adapted to be received within the slot and a keying section adapted to extend out of the slot beyond the end face of the structure, the body section of the key including an enlarged first body portion of polygonal cross-section adapted to be received in the first slot portion, and a second body portion of reduced size adapted to be received in the second slot portion. The slot is sized to receive the body section of the key with a rather close fit to prevent any significant movement of the key longitudinally or laterally within the slot, and the enlarged first slot portion includes opposed side walls which are adapted to cooperate with opposite sides of the polygonal body portion of the key to prevent rotation of the key within the slot and to retain the keying section in a selected orientation.

In accordance with the invention, the slot extends into the structure from a side face of the structure, and the key is adapted to be inserted into the slot from the side face. After the key is positioned in the slot, locking means locks the key within the slot and prevents the key from moving up or down in the slot. Thus the keying system of the invention ensures that the key is reliably retained in the proper position within the slot at all times.

In accordance with a presently preferred embodiment, the structure for defining the generally T-shaped slot comprises the lower backshell of the connector and includes a pair of identical T-shaped slots adjacent opposite sides thereof. The locking means comprises a pair of projections extending inwardly from the inside surface of a cover for the lower backshell. When the cover is mounted to the lower backshell, the projections thereon extend into the slots and cooperate with the second body portions of the keys positioned therein to lock the keys within the slots.

According to a further aspect of the invention, the slots include upper sidewall portions which are tapered inwardly to assist in inserting the keys into the slots. In addition, both the slots and the body portions of the keys include curved surface portions positioned to urge the keys rearwardly within the slots as they are inserted into the slots to assist in their positioning.

Further advantages and specific details of the invention will become apparent hereinafter in conjunction with the following detailed description of a presently preferred embodiment

DETAILED DESCRIPTION OF THE PREFERRED EMBODIMENT

Figure 1:
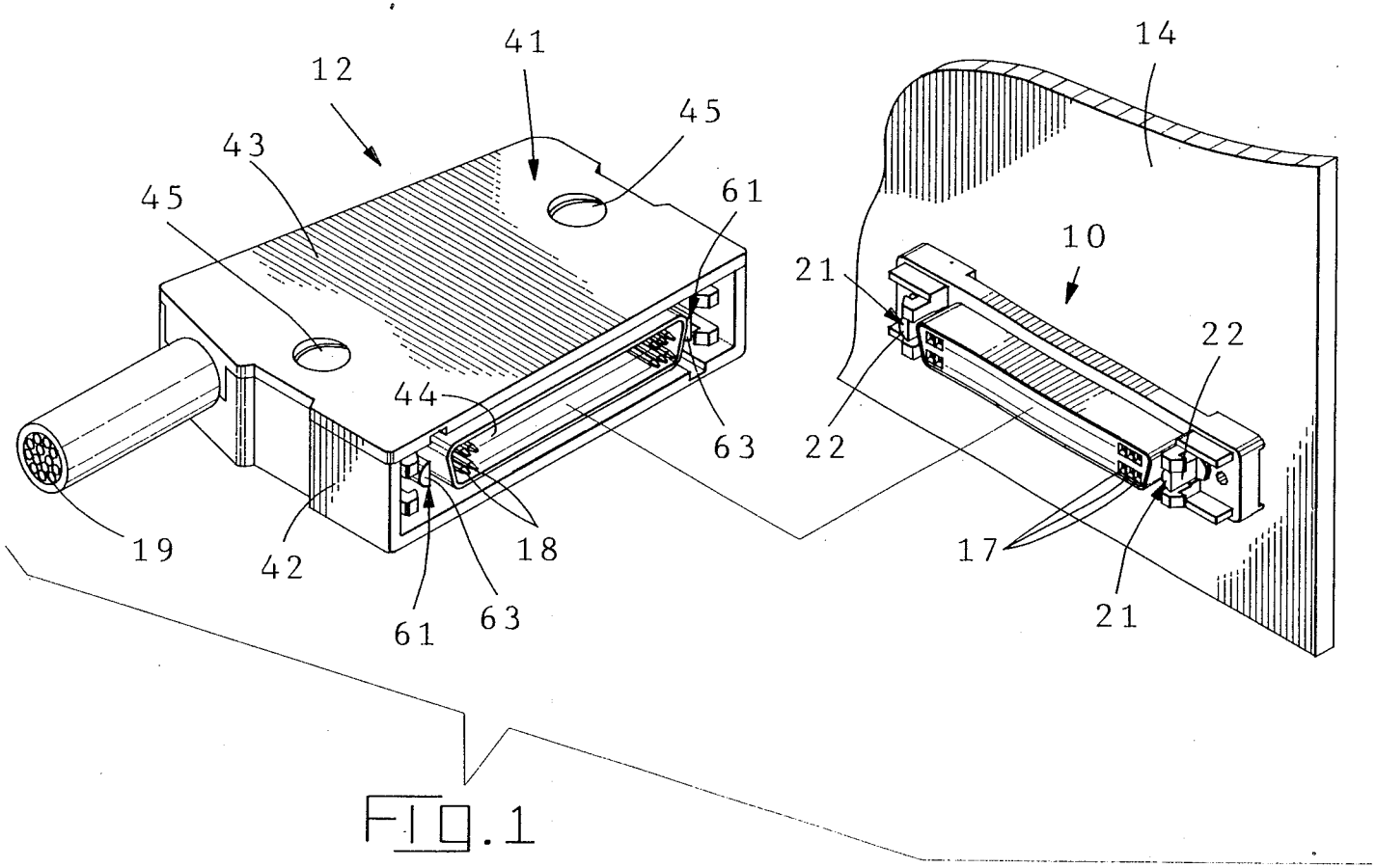
FIG. 1 is a perspective view of a cable-terminating electrical connector incorporating the key retention system of the present invention, and a board-mounted electrical connector complementary therewith.

FIG. 1 illustrates a pair of complementary electrical connectors 10 and 12 of the high density type containing two rows of electrical contacts which are adapted to be mated to complete a plurality of electrical circuits through the connectors.

Connector 10 is designed to be mounted to a printed circuit board or other panel designated by reference numeral 14, and comprises a vertically oriented receptacle connector having a plurality of female contacts 17.

Connector 12 is a cable-terminating connector and comprises a right angle plug connector having a plurality of male contacts 18 which are adapted to be electrically connected to external circuitry via cables 19. The embodiment illustrated and described herein is intended to be exemplary only. Either connector can comprise vertically oriented or right angle connectors, and either can be of the plug or receptacle type as required for a particular application.

Connectors 10 and 12 are particularly designed for use in applications in which a plurality of identical connectors are mounted in close proximity to one another. For example, printed circuit board 14 can comprise a panel on a computer or the like and contain a plurality of connectors 10 to permit various external equipment to be connected to the computer via a plurality of complementary connectors 12 coupled to the external equipment. In such applications, it is important to ensure that each connector be mated with a correct complementary connector as mismatching connector pairs can result in damage to the electrical circuits improperly connected thereby.

To ensure that each connector 10 can mate with only the correct complementary connector 12, the connectors include a keying system to prevent incorrect connector pairs from being mated. More particularly, connector 10 includes a pair of keys 21 which include keying sections 22 which can be positioned at any selected one of a plurality of orientations. Connector 12 similarly includes a pair of keys 61 having keying sections 63 which are also positioned in a selected orientation. As is known to those skilled in the art, if the keys of connectors 10 and 12 are properly oriented with respect to one another, the keying sections thereof pass by each other as the connectors are mated permitting the connectors to properly mate. If, however, the keys are not properly oriented with respect to one another, their keying sections will impinge against one another during mating to prevent the connectors from being mated. The keying system thus permits connectors to mate with only the proper complementary connector and not with an incorrect complementary connector.

For the keying system to operate properly during mating of the connectors 10 and 12, it is important that the keys 21 and 61 of the connectors be properly positioned and oriented with respect to one another. If any of the keys move or shift to any appreciable extent within their respective connector, the keying system may operate improperly and prevent the proper mating of connectors which are intended to be mated or permit the mating of connectors which are not intended to be mated. The present invention provides a key retention system for cable-terminating connector 12 which is effective in permitting keys 61 to be quickly positioned within connector 12 in the correct orientation and which reliably retains the oriented keys firmly in the selected orientation.

With reference to FIG. 1 cable-terminating connector 12 includes a housing 41 comprised of a lower backshell 42 and a cover 43 secured thereto by screws 45. A plastic insert 44 is supported within housing 41 and includes a plurality of passageways for supporting the plurality of male contacts 18. Cables 19, connected to the male contacts 18, extend out of the connector through an opening in the lower backshell.

Figure 2:
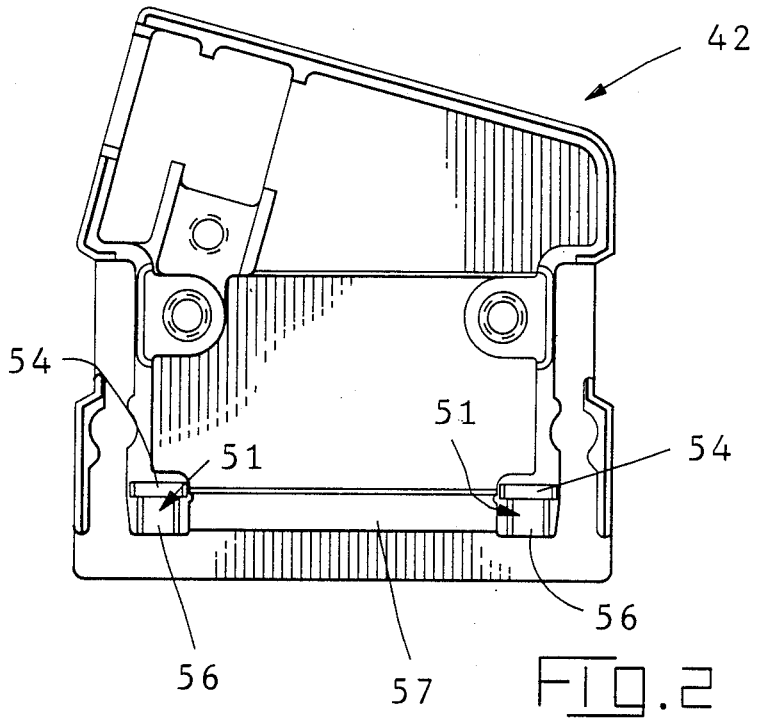
FIG. 2 is a top view of the lower backshell of the cable-terminating connector of FIG. 1.
Figure 3:
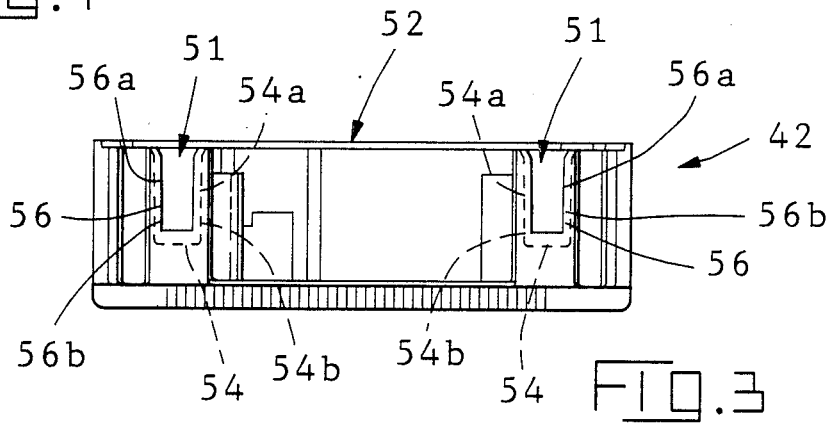
FIG. 3 is a front end view of the lower backshell of FIG. 2.

FIGS. 2–5 illustrate cable-terminating connector 12 in greater detail. As shown in FIGS. 2 and 3, lower backshell 42 includes a pair of identical slots 51 extending thereinto from substantially opposite sides of the top side face 52 thereof. As shown in FIG. 2, slots 51 have a generally T-shaped configuration when viewed from the top side and include an enlarged first slot portion 54 and a second slot portion 56 of reduced size. Slot portion 54 is both wider and deeper than slot portion 56 as shown in FIG. 3, and slot portion 56 extends from slot portion 54 to the front end face 57 of lower backshell 42.

When viewed from the front end 57 as shown in FIG. 3, the slot portions 54 and 56 are of generally rectangular shape. The side walls of the slot portions 54 and 56, however, include first upper side wall portions **54*a* and 56*a*, respectively, which are tapered inwardly from top surface 52; and second lower side wall portions 54*b* and 56*b***, respectively, which are substantially parallel.

Figure 5:
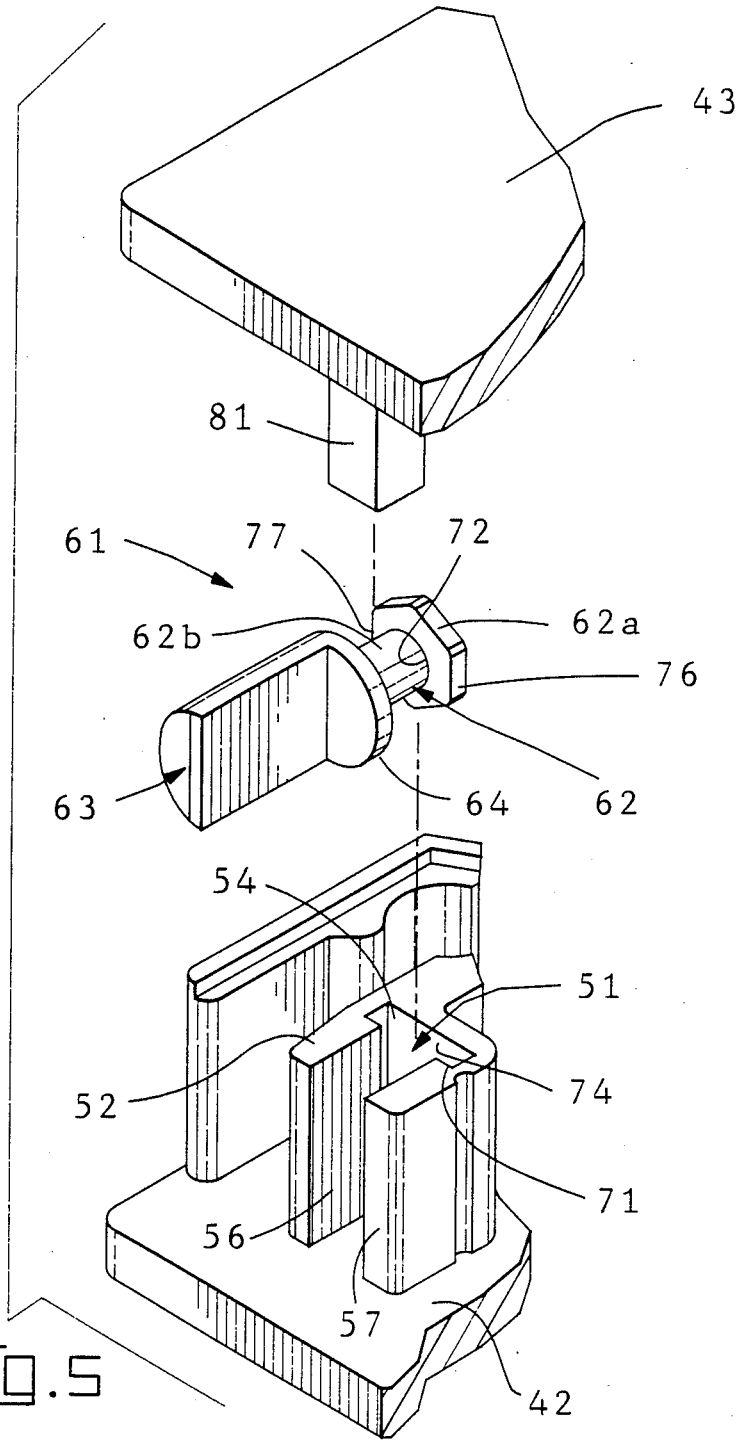
FIG. 5 is an exploded perspective view of a portion of the cable-terminating connector of FIG. 1.

Each slot 51 is adapted to receive a key 61 as illustrated in FIG. 5. Key 61 includes a body section 62 and a keying section 63. Body section 62 is adapted to extend into and be received within a slot 51 and includes an enlarged first body portion **62*a* and a second body portion 62*b* of reduced size. Keying section 63 is of generally semi-circular cross-section and is adapted to extend outwardly of slot 51 beyond front end face 57 to cooperate with a keying section 22 of a key 21 on complementary connector 10**.

Enlarged first body portion **62*a* of key 61 has a polygonal cross-section, preferably a hexagonal cross-section, and is adapted to be received in enlarged first slot portion 54. As is known to those skilled in the art, the polygonal shape of body portion 62*a* defines the different possible orientations of keying section 63, and is inserted into the slot in the selected orientation. Body portion 62*b* of key 61 is of circular cross-section and is adapted to be received in slot portion 56. Key 61 also includes an annular flange 64 which is positioned against front end face 57 of lower backshell 42 when key 61 is positioned within slot 51**.

Slot 51 and the body section of key 61 are sized so that key 61 fits within slot 51 with a rather close fit such that when the key is positioned within the slot, it will be unable to move longitudinally or laterally to any significant extent. The tapered upper wall portions **54*a* and 56*a* of the slot, however, assist in inserting the key into the slot. In addition, the corner 71 of the enlarged first slot portion and the annular corner 72 of the key between key body portions 62*a* and 62*b* are somewhat rounded to urge the key rearwardly into the slot against back surface 74** as the key is inserted into the slot to assist in positioning the key.

The key is inserted into the slot after rotating the key to orient keying section 63 to a desired orientation. After the key is inserted into the slot in the selected orientation, the opposed side faces of the polygonal enlarged first body portion 62*a* of key 61, i.e., surfaces 76 and 77, are parallel to the parallel, lower side wall portions 54*b* of the enlarged first slot portion and fit very closely therebetween such that the key is thereafter prevented from rotating to any appreciable extent within the slot.

Thus, when key 61 is inserted into slot 51, the key will be accurately positioned within the slot and is prevented from rotating and moving either laterally or longitudinally within the slot.

Figure 4:
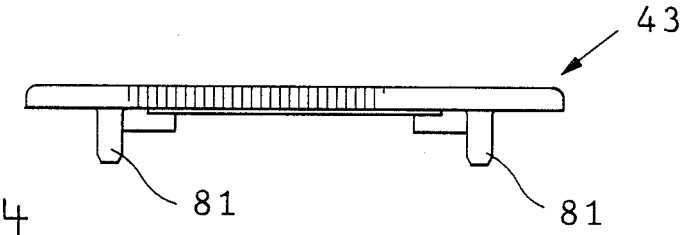
FIG. 4 is a front end view of the cover of the cable-terminating connector of FIG. 1.

The key is locked in position in the slot and prevented from moving up or down within the slot when cover 43 is mounted to the lower backshell 42. More particularly, as shown in FIG. 4, cover 43 is includes a pair of projections 81 which extend downwardly from the inside surface thereof. When cover 43 is mounted to backshell 42, the projections 81 extend into slots 51 and press against second body portions 62*b* of the keys 61 and lock the keys in the slots and prevent the keys from moving up or down in the slots. By extending between annular flange 64 and enlarged first body portion 62*a* of the keys, projections 81 also assist in preventing longitudinal movement of the keys in the slots. The slots are preferably designed such that when the keys are locked in the slots, the keys are located on the centerline of the connector.

Although what has been described herein constitutes a presently preferred embodiment of the invention, it should be recognized that the invention could take numerous other forms. Accordingly, it should be understood that the invention is to be limited only insofar as is required by the scope of the following claims.

We claim:

1. An electrical connector comprising:

a housing having a slot extending thereinto, said slot having a wider first region and a narrower second region, said narrower second region opening onto the wider first region and an exterior surface of the housing; and a key having a body section adapted to be received within said slot and a keying section adapted to extend out of said slot beyond said exterior surface of said housing, said body section including a wider first body portion adapted to be received in the wider first region of said slot and a narrower second body portion adapted to be received in the narrower second region of said slot, at least one of said regions of said slot having opposed side walls which are adapted to cooperate with the body portion of said key which is adapted to be received within said at least one region of said slot to prevent rotation of said key when said key is received within said slot.

2. An electrical connector as recited in claim 1 wherein said wider first region further comprises opposed side walls which are adapted to cooperate with said wider first body portion to prevent rotation of said key within said slot, thereby retaining said key in a predetermined orientation.

3. An electrical connector as recited in claim 1 wherein said slot includes curved surface portions for assisting in positioning said key in said slot.

4. An electrical connector as recited in claim 1 wherein said first and second slot regions include upper side wall portions which are tapered inwardly from said first exterior surface to assist in inserting said key into said slot.

5. An electrical connector as recited in claim 1 wherein said at least one region of said slot comprises said first wider slot region.

6. An electrical connector as recited in claim 1 wherein said connector comprises a cable terminating connector.

7. An electrical connector as recited in claim 1 wherein the slot extends into said housing from a first exterior surface.

8. An electrical connector as recited in claim 7 wherein said narrower second region of the slot opens onto a second exterior surface of the housing.

9. An electrical connector as recited in claim 1 further comprising locking means adapted to extend into said slot for locking said key in said slot.

10. An electrical connector as recited in claim 9 wherein said locking means extends into said slot from said first exterior surface of said housing.

11. An electrical connector as recited in claim 9 wherein said projection is adapted to extend into said narrower second region of said slot for cooperating with said narrower second body portion of said key for locking said key in said slot.

12. An electrical connector as recited in claim 9 wherein said locking means comprises a projection on a cover for said housing, said projection adapted to extend into said slot from said first exterior surface to prevent said key from being removed therefrom when said cover is mounted on said housing.

13. An electrical connector as recited in claim 12 and further including means for releasably connecting said cover to said housing for releasably locking said key in said slot.

14. An electrical connector as recited in claim 12 wherein said housing has a pair of spaced slots extending thereinto from said first exterior surface thereof and a key is adapted to be received within each of said pair of slots, and wherein said locking means includes a pair of spaced projections on said cover adapted to extend into said pair of slots form said first exterior surface to prevent said first exterior surface to prevent said keys from being removed therefrom when said cover is mounted on said housing.

15. An electrical connector as recited in claim 9 wherein said opposed side walls of said at least one region of said slot includes lower side wall portions which are substantially parallel to one another.

16. An electrical connector as recited in claim 15 wherein said body portion of said key which is adapted to be received within said at least one region of said slot is of polygonal cross-section, and wherein said lower side wall portions are adapted to cooperate with opposite sides of said body portion of polygonal cross-section to prevent rotation of said key when said key is received within said slot.

* * * * *